US008668156B2

(12) United States Patent
Lee et al.

(10) Patent No.: US 8,668,156 B2
(45) Date of Patent: Mar. 11, 2014

(54) DIRECT INJECTION INJECTOR FOR ENGINE

(75) Inventors: Juhun Lee, Gwangmyeong-si (KR); Jinkook Kong, Suwon-si (KR); Youngnam Kim, Hwaseong-si (KR); Bumyong Park, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 169 days.

(21) Appl. No.: 12/947,073

(22) Filed: Nov. 16, 2010

(65) Prior Publication Data

US 2012/0085841 A1 Apr. 12, 2012

(30) Foreign Application Priority Data

Oct. 6, 2010 (KR) ..... 10-2010-0097215

(51) Int. Cl.
*B05B 1/32* (2006.01)

(52) U.S. Cl.
USPC ..... 239/453; 239/126; 239/459; 239/460; 239/533.7; 239/533.12

(58) Field of Classification Search
USPC ..... 239/126, 451–453, 456, 459, 460, 239/533.7, 533.12
See application file for complete search history.

(56) References Cited

U.S. PATENT DOCUMENTS

| | | | | |
|---|---|---|---|---|
| 2,035,203 | A * | 3/1936 | Smith | 239/5 |
| 2,914,257 | A * | 11/1959 | Wiant | 239/401 |
| 5,020,728 | A * | 6/1991 | Linder et al. | 239/533.12 |
| 6,340,121 | B1 * | 1/2002 | Lambert | 239/533.4 |
| 7,581,686 | B2 | 9/2009 | Holzgrefe et al. | |
| 2005/0145713 | A1 | 7/2005 | Reiter et al. | |

FOREIGN PATENT DOCUMENTS

| | | | |
|---|---|---|---|
| JP | 8-14134 | A | 1/1996 |
| JP | 8-254169 | A | 10/1996 |
| JP | 2006510838 | A | 3/2006 |
| JP | 2008506879 | A | 3/2008 |
| JP | 4460895 | B2 | 2/2010 |
| KR | 1020040054734 | A | 6/2004 |

* cited by examiner

*Primary Examiner* — Christopher Kim
(74) *Attorney, Agent, or Firm* — Morgan, Lewis & Bockius LLP

(57) ABSTRACT

A direct injection injector for an engine includes a body forming the outer structure and having a space therein, a needle inserted to slide linearly in the body and having a hole therein forming a fuel channel, and a cylinder nozzle fitted on needle to communicate with hole and having a nozzle hole for injecting fuel, such that it is possible to prevent caulking in which the nozzle of the injector is clogged with soot while injecting fuel at relatively low pressure, change the spray type of the injected engine in various shapes, and sufficiently decrease the size of droplet of the fuel.

8 Claims, 9 Drawing Sheets

DIRECT INJECTION INJECTOR FOR ENGINE

CROSS-REFERENCE TO RELATED APPLICATIONS

The present application claims priority to Korean Patent Application Number 10-2010-0097215 filed Oct. 6, 2010, the entire contents of which application is incorporated herein for all purposes by this reference.

BACKGROUND OF THE INVENTION

1. Field of the Invention

The present invention relates to a direct injection injector for an engine, and more particularly, to a structure of an injector directly injecting fuel for combustion of the engine into the combustion chamber.

2. Description of Related Art

Direct injection injectors that directly inject fuel into the combustion chamber of an engine falls into an inward type where an needle assembly moves inside the injector and an outward type where injector moves outside, in injection.

As for the inward type of injectors, the inside of the end of the injector is exposed to flame in the combustion chamber and caulking in which the nozzle of the injector is clogged due to contamination of the end of the injector by soot generated after combustion may occur, such that the injection pressure of the fuel is increased to prevent the nozzle from clogging up.

Meanwhile, the outward type of injector is shown in FIG. 1, where since a needle assembly 500 moves outside an injector 502, a ring with a predetermined space is formed between the outside of injector 502 and needle assembly 500 and the ring function as a nozzle injecting fuel, such that the fuel is injected in a cone shape, and needle assembly 500 moves outward, such that it is possible to prevent the nozzle from cogging with soot.

However, the nozzle that is open for fuel injection in injector 502 is formed in a considerably large conical shape, when fuel fails to be injected at high pressure in the outward type of injector 502, the size of droplet of the fuel is not sufficiently decreased, such that the fuel and air cannot be sufficiently mixed.

That is, when the fuel fails to be injected at high pressure, caulking is caused in the inward type and there are problems in the spray type and the size of droplet of the fuel in the outward type.

The information disclosed in this Background section is only for enhancement of understanding of the general background of the invention and should not be taken as an acknowledgement or any form of suggestion that this information forms the prior art already known to a person skilled in the art.

BRIEF SUMMARY OF THE INVENTION

The present invention has been made in an effort to provide a direct injection injector for an engine that that can prevent caulking in which the nozzle of the injector is clogged with soot while injecting fuel at relatively low pressure, change the spray type of the injected engine in various shapes, and sufficiently decrease the size of droplet of the fuel.

On aspect of the present invention provides a direct injection injector for an engine, which includes a body forming the outer structure and having a space therein, a needle inserted to be slidable straight in the body and having a hole therein which is a channel of fuel, and a cylinder nozzle fitted on the needle to communicate with the hole and having a nozzle hole for injecting the fuel.

Another aspect of the present invention provides a direct injection injector for an engine, which includes a straight needle having a hole therein, a body covering the outer side of the needle and allowing the needle to slight straight, a nose formed at the end of the needle to isolate the inside of the body from the outside when the needle has moved inside the body as much as possible, and a cylinder nozzle inserted close to the nose of the needle, at least partially communicating with the outside through the space between the needle and the body when the needle moves outside the body, and having at least one or more nozzle holes communicating with the hole at the above communicating portion.

According to various aspects of the present invention, it is possible to prevent caulking in which the nozzle of the injector is clogged with soot while injecting fuel at relatively low pressure, change the spray type of the injected engine in various shapes, and sufficiently decrease the size of droplet of the fuel.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
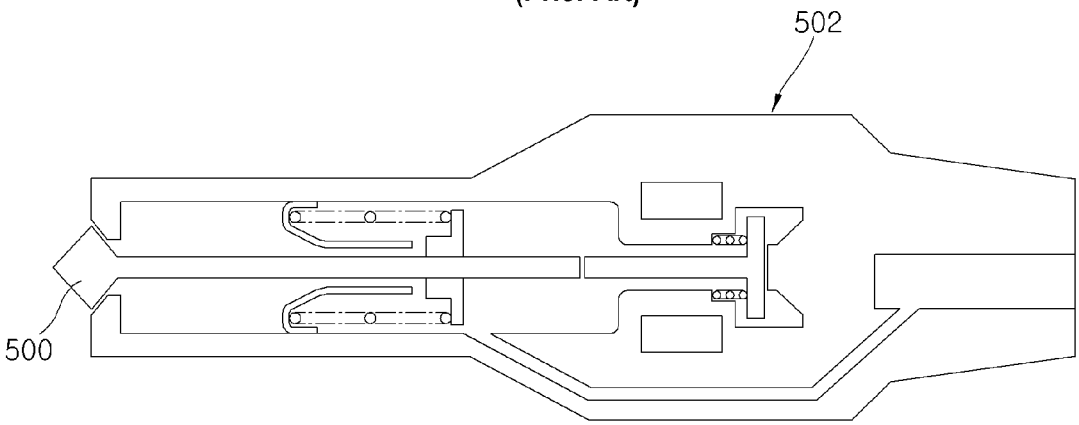
FIG.1 (Prior Art)
FIG. 1 is a view illustrating the structure of an outward type of direct injection injector according to the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIGS. 2 to 8, various embodiments of the present invention may include a body 1 forming the outer structure and having a space therein, a needle 3 inserted to be slidable straight in body 1 and having a hole 5 therein which is a channel of fuel, and a cylinder nozzle 9 fitted on needle 3 to communicate with hole 5 and having a nozzle hole for injecting the fuel.

Figure 2:
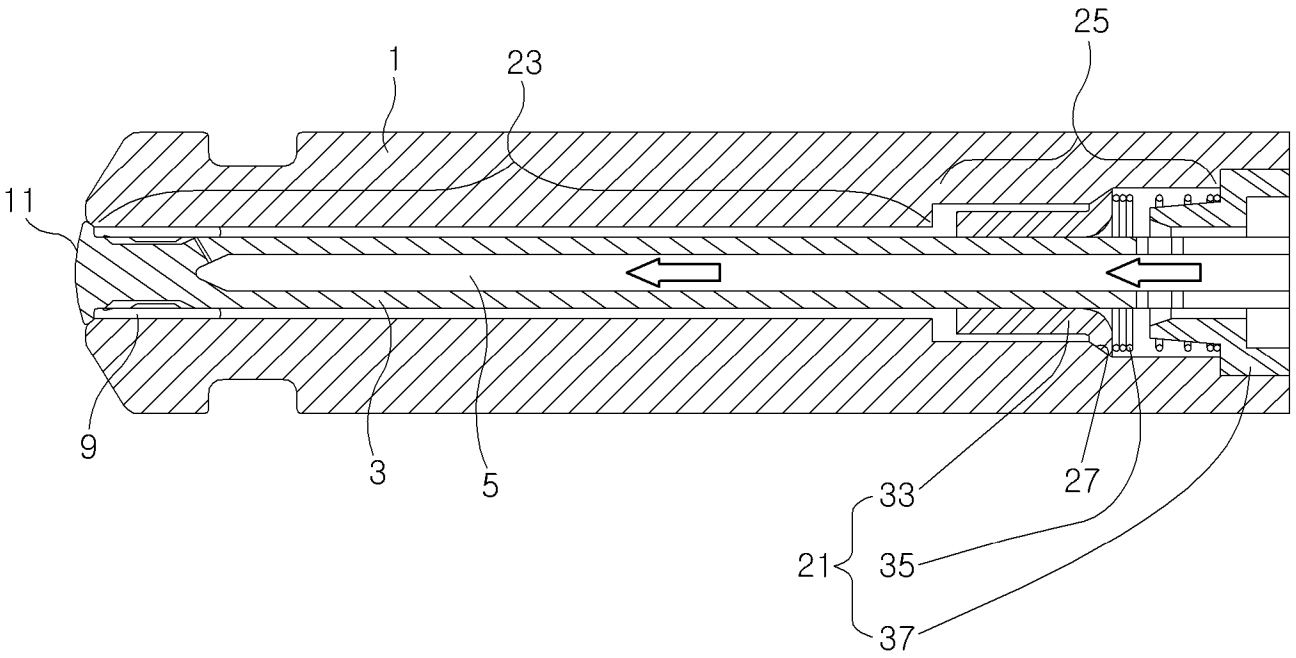
FIG. 2 is a view showing an exemplary direct injection injector for an engine according the present invention.

For reference, the outer side of the injector is the end of the injector, like the left side of body 1 of FIG. 2, and the inner side of the injector is the opposite side, the right side.

The space in body 1 has a diameter at least larger than the outer diameter of cylinder nozzle 9 and a nose 11 sized larger than the outer diameter of cylinder nozzle 9 is formed at the end of needle 3, such that nose 11 contacts the end of body 1 when needle 3 moves into body 1 to close the space in body 1 where cylinder nozzle 9 is positioned.

The contact surface of nose 11 contacting the end of body 1 is formed in a cone shape and nozzle hole 7 of cylinder nozzle 9 communicates with the space between nose 11 and the end of body 1 when needle 3 moves outside body 1.

Figure 6:
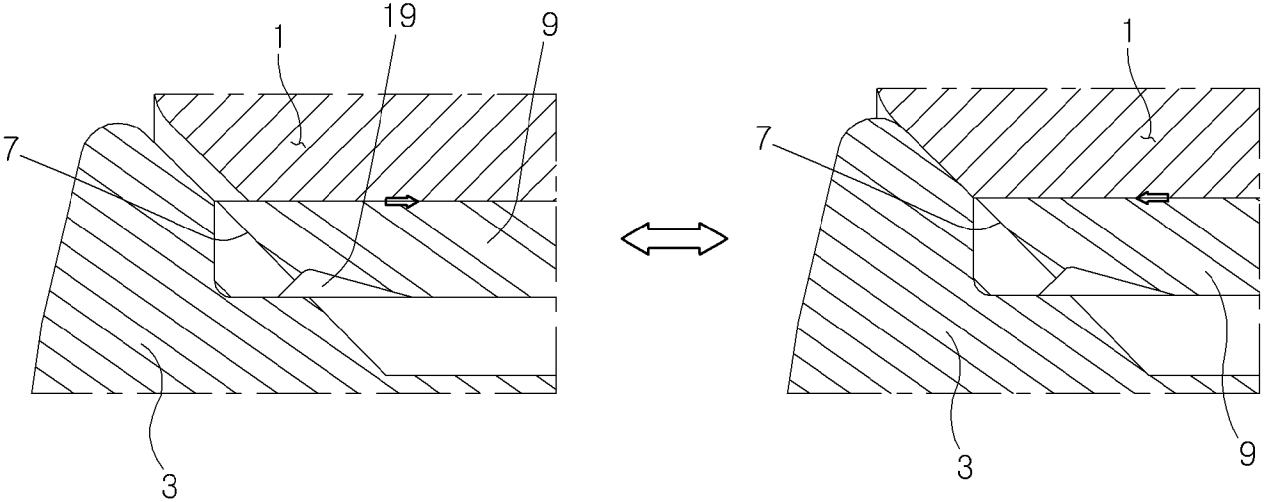
FIG. 6 is a view comparing the operation of injecting fuel of the injector of FIG. 2.

Therefore, the fuel is substantially injected from the injector through nozzle hole 7 of cylinder nozzle 9 through hole 5 of needle 3 and whether to inject the fuel depends on whether a space is formed between nose 11 and the end of nose 1 by needle 3 that has moved outside the injector, as shown in FIG. 6.

Figure 3:
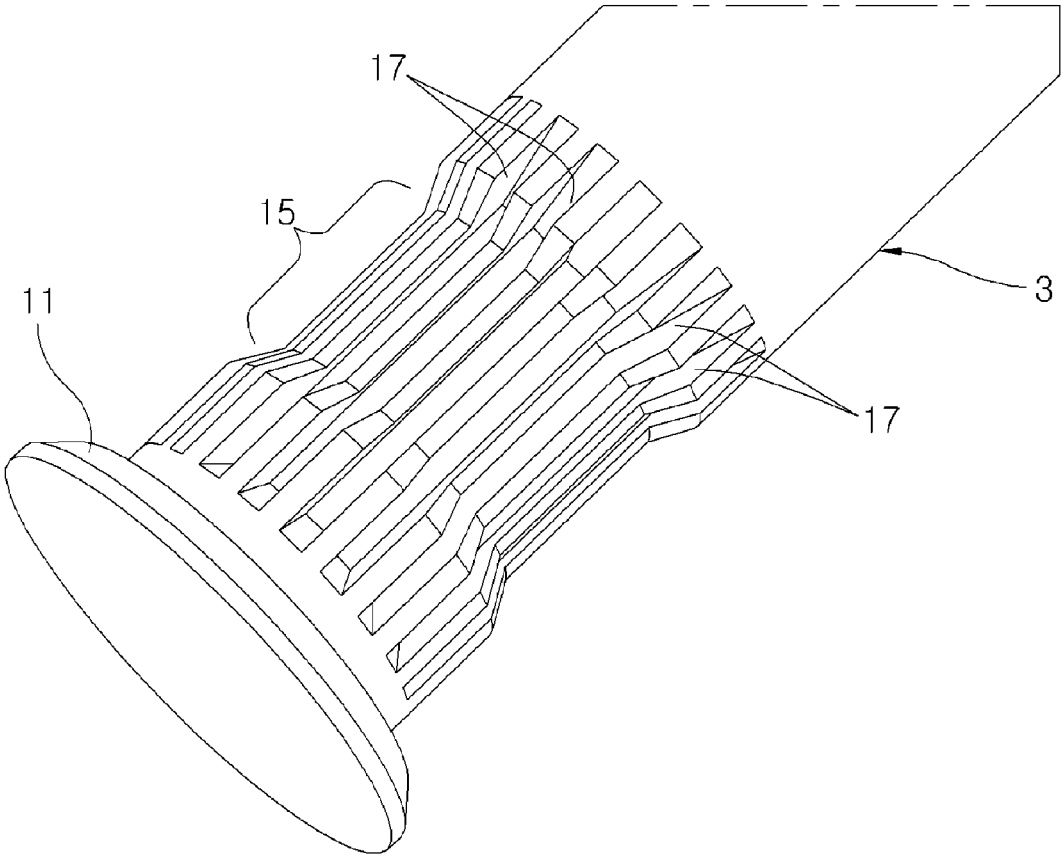
FIG. 3 is a view showing in detail the end of a needle of FIG. 2.
Figure 4:
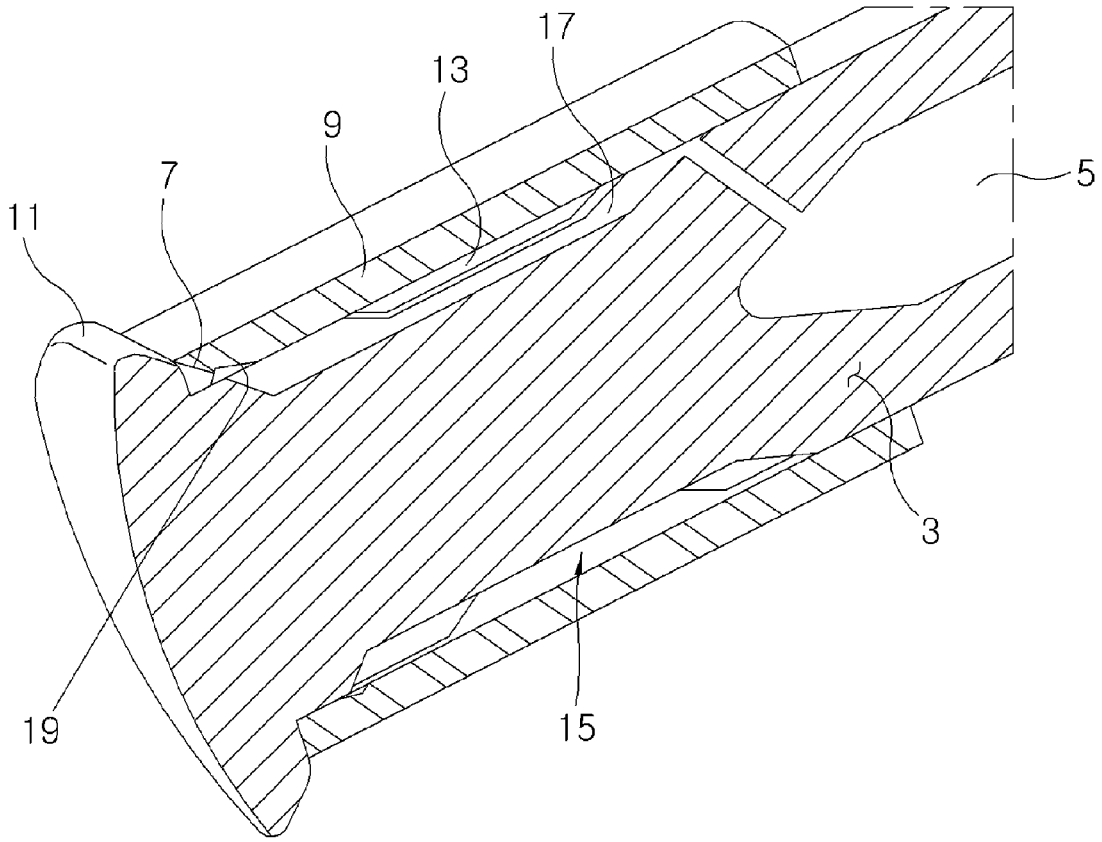
FIG. 4 is a view showing in detail the structure of the needle of FIG. 2 and a cylinder nozzle.
Figure 5:
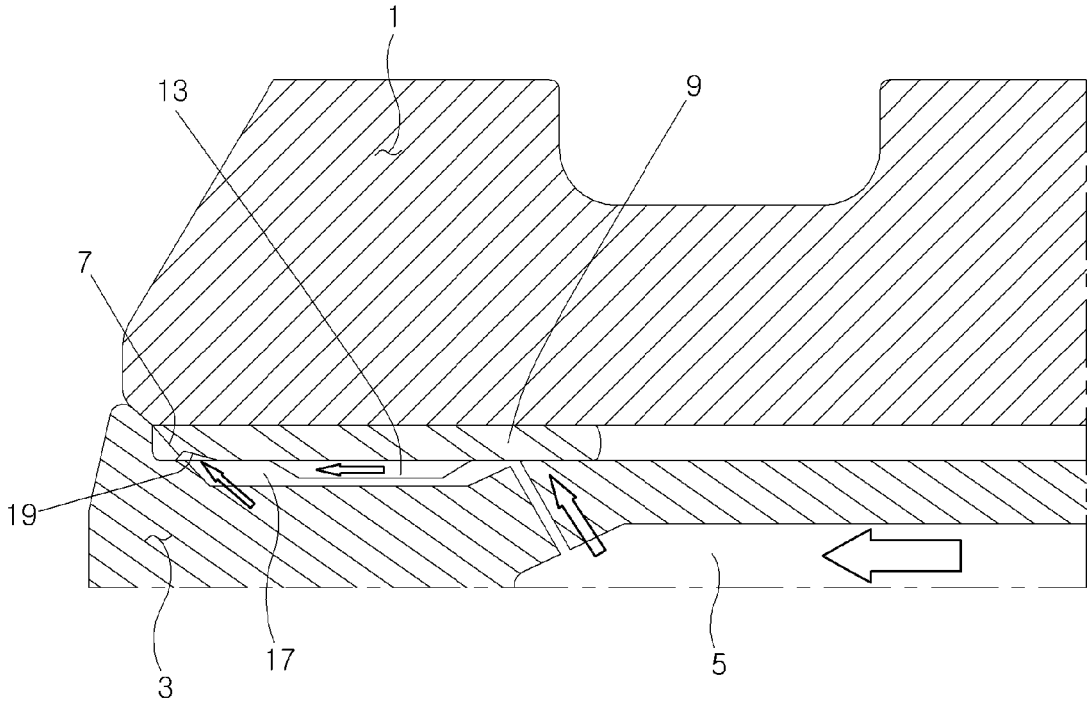
FIG. 5 is a cross-sectional view showing in detail the structure of the end of the injector of FIG. 2.

Referring to FIGS. 3 to 5, a depression 15 recessed inside from the outer circumference of needle 3 to form a middle chamber 13 together with the inner side of cylinder nozzle 9 is formed where cylinder nozzle 9 is fitted on needle 3, and has a plurality of depressed grooves 17 communicating with hole 5.

Middle chamber 13 temporarily stores a predetermined amount of fuel supplied from hole 5 to nozzle hole 7 to keep the fuel stable supplied to nozzle hole 7.

Depressed holes 17 are arranged at regular intervals along the circumference of needle 3 and have the same shape extending longitudinally along needle 3.

In particular, as shown in FIG. 6, a nozzle groove 19 communicating with middle chamber 13 and nozzle hole 7 is further formed on the inner side of cylinder nozzle 9.

Therefore, the fuel injected from nozzle hole 7 is supplied to middle chamber 13 through depression grooves 17 from hole 5 of needle d, as shown in FIG. 5, and then discharged from nozzle hole 7 through nozzle groove 19.

A pressure valve 21 is provided in body 1 for lubrication due to flow of fuel between cylinder nozzle 9 and body 1.

The space in body 1 has a first space 23 having a diameter allowing fuel for lubrication between cylinder nozzle 9 and the body to flow and a second space 25 communicating with first space 23 in body 1, having a diameter larger than first space 23, and accommodating pressure valve 21, where second space 25 has a locking portion 27 increasing in diameter toward the inside of the injector.

In this configuration, first space 23, as shown in the figures, is applied to substantially most length of needle 3 in the same way and defines a predetermined gap substantially corresponding to the thickness of cylinder nozzle 9 between the first space and the outer circumference of needle 3, and the gap is filled with fuel to effectively remove heat generated in operating the injector, thereby help improving durability of the injector.

Pressure valve 21 includes a cylindrical portion 29 having an inner circumference that is fitted on the outer circumference of needle 3 such that fuel can flow for lubrication and has an outer diameter larger than the diameter of first space 23 and smaller than the diameter of second space 25, a valve spool 33 having a flange 31 integrally extending from cylindrical portion 29 and having an enlarged diameter to be locked to locking portion 27, a spring 35 elastically pressing flange 31 of valve spool 33 such that flange 31 is in close contact to locking portion 27, and a spring retainer 37 supporting spring 35 against body 1. One will appreciate that the cylindrical portion and flange may be monolithically formed.

The configuration of various embodiments of the present invention described above may be described in different way as the following. Various embodiments of the present invention may include straight needle 3 having hole 5 therein, body 1 covering the outer side of needle 3 and allowing needle 3 to slight straight, nose 11 formed at the end of needle 3 to isolate the inside of body 1 from the outside when needle 3 has moved inside body 1 as much as possible, and cylinder nozzle 9 inserted close to nose 11 of needle 3, at least partially communicating with the outside through the space between needle 3 and body 1 when needle 3 moves outside body 1, and having at least one or more nozzle hole 7 communicating with hole 5 at the above communicating portion.

Pressure valve 21 guiding the fuel in between cylinder nozzle 9 and body 1 to contribute to lubrication is provided in body 1 and cylinder nozzle 9 is press-fitted on needle 3.

The space, which has a first space 23 having a diameter allowing flow of fuel for lubrication between cylinder nozzle 9 and the body to flow and a second space 25 communicating with first space 23 in body 1, having a diameter larger than first space 23, and accommodating pressure valve 21, and having locking portion 27 increasing in diameter toward the inside of the injector to lock pressure valve 21 by locking portion 27, is defined in body 1.

Pressure valve 21 includes valve spool 33 disposed slidable straight in the straight sliding direction of the nozzle, the spring elastically supporting valve spool 33 outside the injector to be locked to locking portion 27, and spring retainer 37 supporting the spring against body 1.

Valve spool 33 has cylindrical portion 29 having the inner diameter determined such that the outer circumference of needle 3 is inserted and the fuel is allowed to flow for lubrication, and the outer diameter larger than the diameter of first space 23, and flange 31 integrally extending from cylindrical portion 29, having the enlarged outer diameter, and locked to locking portion 27 when moving outside the injector. One will appreciate that the cylindrical portion and the flange may be monolithically formed.

Flange 31 of valve spool 33 and locking portion 27 of second space 25 are in surface contact with each other in a cone shape.

Nose 11 of needle 3 is formed in a conical shape gradually increasing more than the outer diameter of cylinder nozzle 9 toward the outside the injector in surface contact with the end of body 1 in a cone shape.

In the direct injection injector having the structure described above, injection is controlled by whether cylinder nozzle 9 is exposed to the space between nose 11 and body 1 by straight sliding of needle 3, such that the injector can be considered as an outward type of injector, and caulking of the related art in which the nozzle is clogged with soot, a combustion production, can be prevented even without making the injection pressure of fuel relatively high.

The number, shape, size, and arrangement of nozzle holes 7 formed in cylinder nozzle 9 may be modified in various ways.

Therefore, it is possible to ensure mixing performance of air and fuel at high level by making the diameter of nozzle holes 7 appropriately small to sufficiently reduce the size of droplet and it is also possible to implemented various types of fuel injection by changing the number and arrangement of nozzle holes 7 in accordance with features of the engines.

Figure 7:
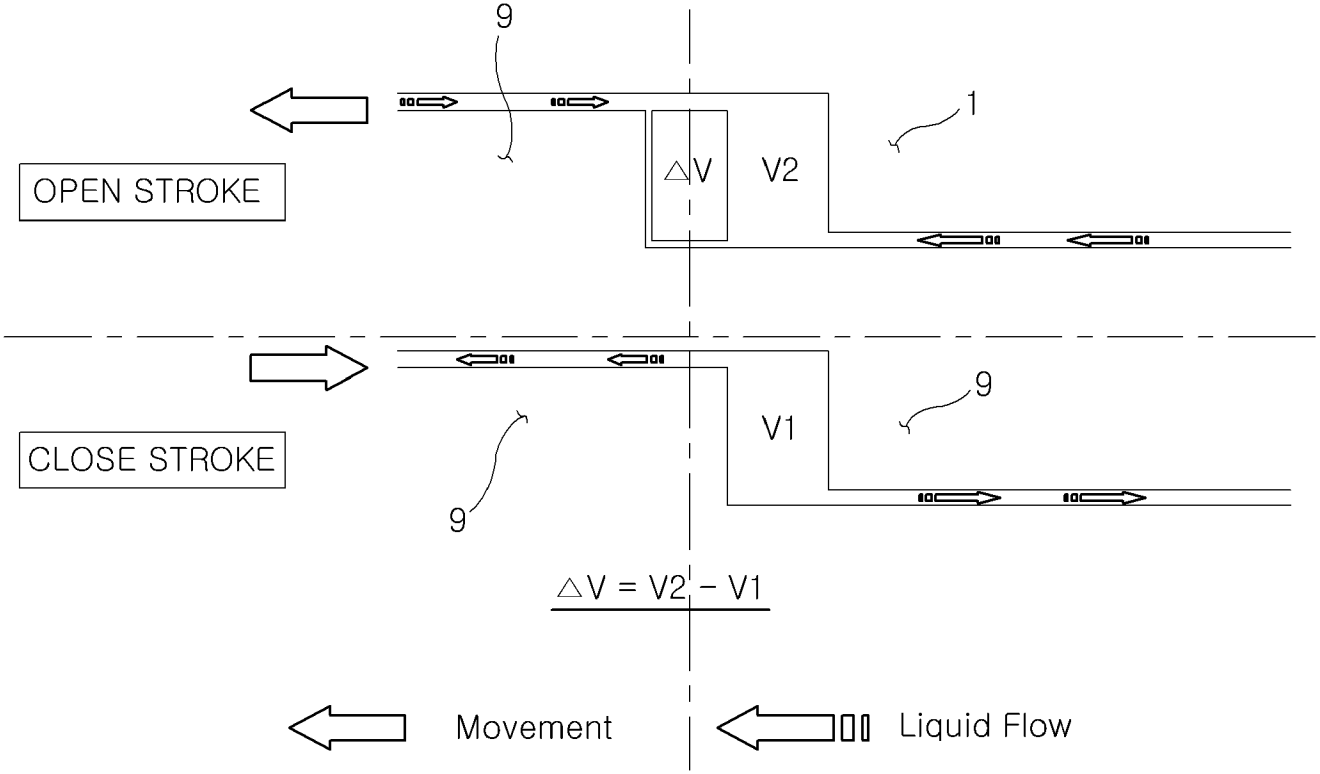
FIG. 7 is a view illustrating an exemplary principle of lubrication between the cylinder nozzle and the body according to the present invention.
Figure 8:
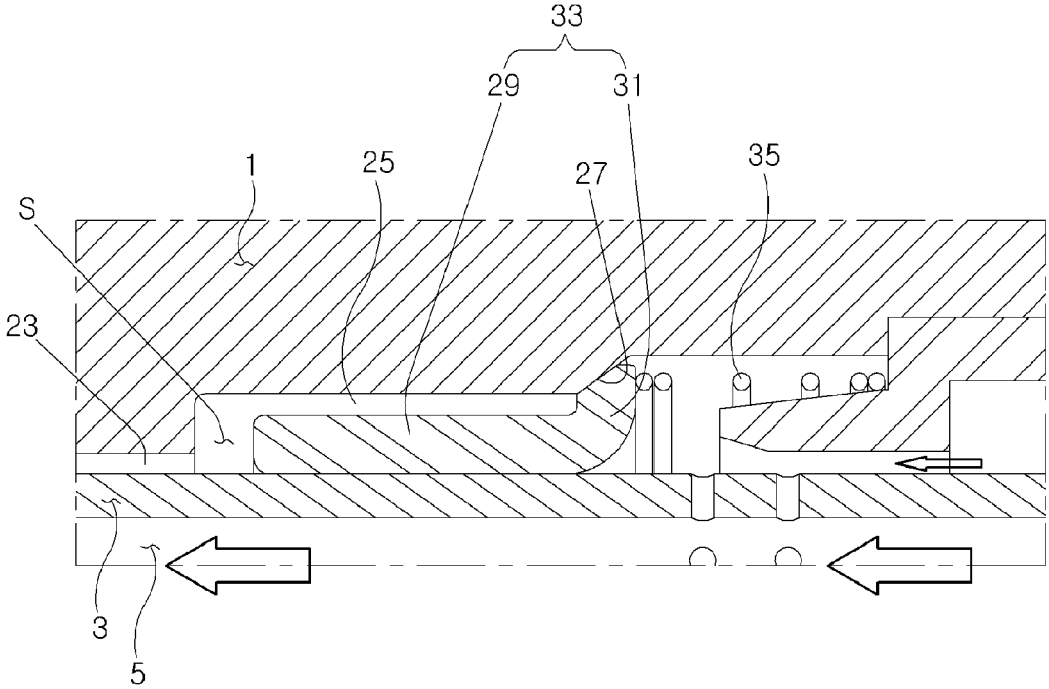
FIG. 8 is a view showing in detail the installation position of a pressure valve of FIG. 2.

FIG. 7 is a view illustrating the principle of lubrication between cylinder nozzle 9 and body 1. As needle 3 moves outside the injector in the open stroke at the upper portion, cylinder nozzle 9 press-fitted on needle 3 moves, in which the pressure adjustment space S defined between body 1 and cylinder nozzle 9 increases in volume by ΔV into V2, due to the movement of cylinder nozzle 9 while in a close stroke, as needle 3 moves into the injector, the volume decreases by ΔV and the pressure adjustment space S between body 1 and cylinder nozzle 9 becomes V1.

That is, V2−V1=ΔV.

The change in volume of the pressure adjustment space S takes an effect of sucking fuel from the space between body 1 and nozzle 9 which is connected with the pressure adjustment space S by reducing the pressure in the pressure adjustment space S in the open stroke, while in the close stroke, it takes an effect of sending the fuel under predetermined pressure into the space between cylinder nozzle 9 and body 1 by increasing the pressure in the pressure adjustment space S, such that fuel continuously flows into between cylinder nozzle 9 and body 1, thereby contributing to cooling and lubricating.

Figure 9:
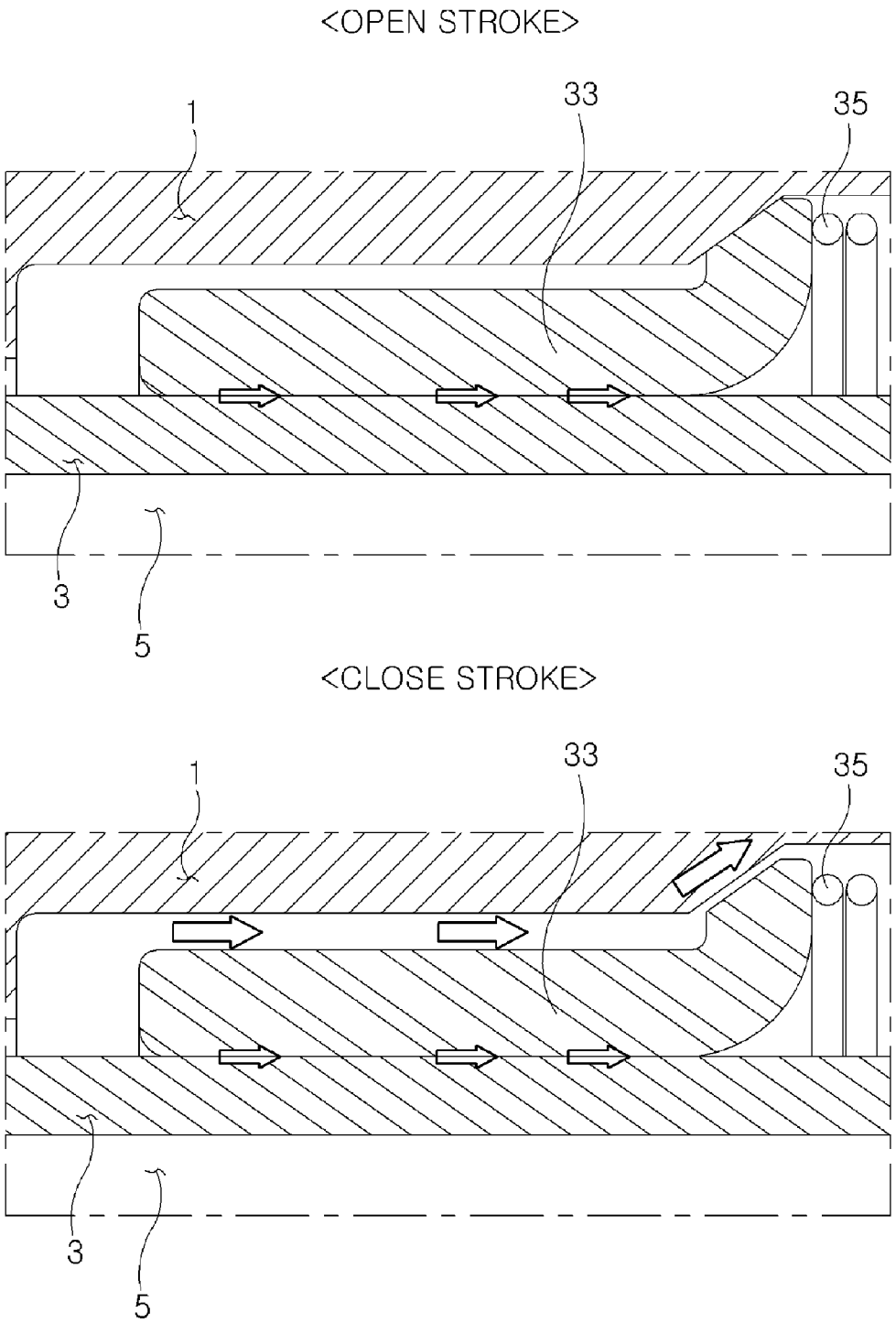
FIG. 9 is a view comparing the operation of the pressure valve of FIG. 2.

Pressure valve 21 is provided for smooth lubrication described above, and referring to FIG. 9, flange 31 of valve spool 33 is locked to locking portion 27 to close the right side of the pressure adjustment space S at predetermined pressure, such that as cylinder nozzle 9 moves in the open stroke at the upper portion, the pressure in the pressure adjustment space S drops, and fuel is sucked from between body 1 and cylinder nozzle 9.

In the close stroke at the lower portion, as needle 3 moves into the injector and cylinder nozzle 9 moves while compressing the fuel, the pressure in the pressure adjustment space S is increased by the spring at a predetermined level, such that the fuel is sent under pressure into between cylinder nozzle 9 and body 1. When the pressure increases above a predetermined level, the spring deforms and flange 31 of spool 33 is moved away from locking portion 27 in order to ensure good operability of needle 3, such that excessive pressure in the pressure adjustment space S is prevented.

Obviously, the injector described above is additionally provided with a device make needle 3 slide straight, such as a solenoid.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A direct injection injector for an engine, comprising:

a straight needle having a hole in the needle and a nose at an end of the needle;

a body having a space that allows the needle to slide linearly in the space; and a cylinder nozzle inserted between an inner surface of the body and an outer side of the needle;

wherein the cylinder nozzle is fitted on a portion of the needle toward the nose, and has a nozzle hole in fluid communication with the hole of the needle;

wherein the needle includes a depression recessed inwardly from an outer circumference of the needle at the portion on which the cylinder nozzle is fitted, thereby forming a middle chamber with an inner side of the cylinder nozzle;

wherein the needle further includes a plurality of depressed grooves formed at the portion on which the cylinder nozzle is fitted and the plurality of depressed grooves are in fluid communication with the hole of the needle; and wherein the nose of the needle is formed in a conical shape with a diameter that is larger than an outer diameter of the cylinder nozzle and gradually increasing toward the outside of the injector, such that the nose of the needle is in surface contact with an end of the body in a cone shape when the needle moves into the space of the body.

2. The direct injection injector for an engine as defined in claim 1, wherein a pressure valve is provided in the body to guide a fuel for lubrication in between the cylinder nozzle and the body.

3. The direct injection injector for an engine as defined in claim 2, wherein the space of the body includes:

a first space having a diameter for allowing the fuel for lubrication between the cylinder nozzle and the body to flow; and a second space having a diameter larger than the first space for accommodating the pressure valve, wherein the second space communicates with the first space and has a locking portion with an increasing diameter toward an inside of the injector for locking the pressure valve in the body.

4. The direct injection injector for an engine as defined in claim 3, wherein the pressure valve includes:

a valve spool disposed slidably in the second space in a straight sliding direction of the cylinder nozzle;

a spring elastically pressing and locking the valve spool to the locking portion; and a spring retainer supporting the spring against the body.

5. The direct injection injector for an engine as defined in claim 4, wherein the valve spool includes:

a cylindrical portion having an inner diameter that allows the needle to be inserted and the fuel to flow for lubrication, and an outer diameter that is larger than the diameter of the first space; and a flange monolithically extending from the cylindrical portion, the flange having an enlarged outer diameter and locked to the locking portion when moving toward the outside of the injector.

6. The direct injection injector for an engine as defined in claim 5, wherein the flange of the valve spool and the locking portion of the second space are in surface contact with each other in a cone shape.

7. The direct injection injector for an engine as defined in claim 1, wherein the plurality of the depressed grooves are arranged at regular intervals along the outer circumference of the needle and extend longitudinally along the needle.

8. The direct injection injector for an engine as defined in claim 7, wherein the cylinder nozzle includes a nozzle groove formed on the inner side of the cylinder nozzle and the nozzle groove is in fluid communication with the middle chamber and the nozzle hole.

* * * * *